US007510069B2

(12) United States Patent
Koljonen et al.

(10) Patent No.: US 7,510,069 B2
(45) Date of Patent: Mar. 31, 2009

(54) VACUUM BELT CONVEYOR FOR TRANSFERRING A WEB THREADING TAIL IN A WEB MANUFACTURING MACHINE

(75) Inventors: Veli-Pekka Koljonen, Kärnä (FI); Mikael Junttonen, Muurame (FI); Matti Lehtonen, Lannevesi (FI)

(73) Assignee: Metso Paper, Inc., Helsinki (FI)

( * ) Notice: Subject to any disclaimer, the term of this patent is extended or adjusted under 35 U.S.C. 154(b) by 438 days.

(21) Appl. No.: 11/077,509

(22) Filed: Mar. 10, 2005

(65) Prior Publication Data

US 2005/0230447 A1 Oct. 20, 2005

(30) Foreign Application Priority Data

Mar. 11, 2004 (FI) ..... 20045069

(51) Int. Cl.
*B65H 29/68* (2006.01)

(52) U.S. Cl. ..... 198/689.1; 198/841; 271/197; 271/271; 101/233; 101/424.1

(58) Field of Classification Search ..... 198/689.1, 198/842, 197, 276, 841; 271/197, 276; 101/424, 101/232, 233
See application file for complete search history.

(56) References Cited

U.S. PATENT DOCUMENTS 2,441,912 A * 5/1948 Streich ..... 355/110
3,649,002 A * 3/1972 Burkhardt ..... 271/96
4,186,480 A * 2/1980 Binder Kriegelstein et al. ..... 29/603.04
4,474,367 A * 10/1984 Jongerling et al. ..... 271/197
4,491,503 A * 1/1985 Adams et al. ..... 162/232
4,555,013 A * 11/1985 Franklin ..... 198/689.1
4,616,920 A 10/1986 Itoigawa et al.
4,626,095 A 12/1986 Berger
4,698,919 A * 10/1987 Wedel ..... 34/117
5,074,539 A * 12/1991 Wells et al. ..... 271/12
5,509,352 A * 4/1996 Kowalewski et al. ..... 101/232
5,545,295 A * 8/1996 Fujita et al. ..... 162/358.1
5,651,313 A * 7/1997 Kowalewski et al. ..... 101/232
5,762,759 A * 6/1998 Wedel ..... 162/193
5,810,350 A * 9/1998 Pollich ..... 271/276
6,358,366 B1 * 3/2002 Hongisto et al. ..... 162/193
6,405,914 B1 6/2002 Broom et al.
6,447,646 B1 * 9/2002 Hassinen et al. ..... 162/281

(Continued)

FOREIGN PATENT DOCUMENTS

DE 100 09 188 8/2001

(Continued)

*Primary Examiner*—Gene Crawford
*Assistant Examiner*—Kavel P Singh
(74) *Attorney, Agent, or Firm*—Stiennon & Stiennon

(57) ABSTRACT

A vacuum belt conveyor for transferring a web threading tail in a web manufacturing machine has a frame construction (15) and an air permeable belt loop (20), which is arranged around rolls (16, 17). The vacuum belt conveyor also has a first vacuum means (22) for creating a vacuum effect for the part of the belt loop (20) that transports the web threading tail (14) and a second vacuum means (23) for creating a vacuum effect in connection with the first roll (16). The second vacuum means (23) is arranged in the frame construction (15) for creating a vacuum to be introduced to the first roll (16) inside the belt loop (20).

18 Claims, 6 Drawing Sheets

U.S. PATENT DOCUMENTS

| | | | | |
|---|---|---|---|---|
| 6,494,452 | B1 * | 12/2002 | Karasiewicz | 271/276 |
| 6,630,057 | B2 * | 10/2003 | Broom et al. | 162/363 |
| 6,648,198 | B2 * | 11/2003 | Demers | 226/95 |
| 6,718,869 | B1 * | 4/2004 | Laitio et al. | 100/41 |
| 6,969,059 | B2 * | 11/2005 | Gafner | 271/69 |
| 6,978,994 | B2 * | 12/2005 | Ingelsten | 271/197 |
| 7,207,558 | B2 * | 4/2007 | Edinger | 271/197 |
| 7,210,679 | B2 * | 5/2007 | Schafer et al. | 271/183 |
| 7,264,693 | B2 * | 9/2007 | Ahvenainen et al. | 162/364 |
| 2003/0089756 | A1 | 5/2003 | Demers | |

FOREIGN PATENT DOCUMENTS

| | | | |
|---|---|---|---|
| DE | 100 09 188 | A1 | 8/2001 |
| EP | 1 063 188 | | 12/2000 |
| EP | 1 063 188 | A2 | 12/2000 |
| EP | 1 127 978 | | 8/2001 |
| EP | 1 127 978 | A2 | 8/2001 |
| FI | 105573 | | 9/2000 |
| FI | 105573 | B | 9/2000 |
| FI | 5440 | | 7/2002 |
| GB | 1 533 720 | | 3/1976 |
| WO | WO 03/018909 | | 3/2003 |
| WO | WO 03/018909 | A1 | 3/2003 |

* cited by examiner

VACUUM BELT CONVEYOR FOR TRANSFERRING A WEB THREADING TAIL IN A WEB MANUFACTURING MACHINE

CROSS REFERENCES TO RELATED APPLICATIONS

This application claims priority on Finnish Application No. 20045069, Filed Mar. 11, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a vacuum belt conveyor for transferring a web threading tail in a web manufacturing machine, the belt conveyor comprising

- a frame construction and at least two pulleys or rolls therein,
- an air permeable belt loop, which is arranged around the rolls,
- first vacuum means for providing a vacuum effect for the part of the belt loop that transports the web threading tail, and
- second vacuum means for providing a vacuum effect in connection with the first roll of the said rolls.

WO publication No. 03018909 discloses a vacuum belt conveyor according to the preamble, which is characterized by a vacuum effect in connection with the first roll. Thus the vacuum can be used to detach the web threading tail from a dryer surface, for example, without separate air blows or doctors. In the proposed tail threading device the vacuum is generated for the first roll with a venturi, which has a ring nozzle. The ring nozzle is located outside the vacuum belt conveyor, at the end of its pipe bracket. From the pipe bracket the vacuum is distributed by means of a bent pipe to a vacuum chamber arranged inside the frame construction and further to the first roll.

Locating the venturi at the end of the pipe bracket complicates the construction of the vacuum belt conveyor, which increases the purchase costs of the apparatus. In addition, the operating efficiency of the venturi is poor. The situation is further impaired by the distance of the venturi from the roll. In practice, a significant part of the vacuum discharges in the constructions, which further impairs the total operating efficiency of the venturi and increases the operating costs of the vacuum belt conveyor. Vacuum adjustment is also difficult and a great amount of compressed air is required for achieving a sufficient vacuum.

SUMMARY OF THE INVENTION

The object of the invention is to provide a new type of vacuum belt conveyor, for transferring a web threading tail in a web manufacturing machine, which has a simpler construction than heretofore and with which it is possible to create a vacuum effect more advantageously than heretofore. In the vacuum belt conveyor according to the invention, the vacuum means required for the underpressurization of the first roll are arranged in the frame construction. Thus the vacuum is not created until at the application point, avoiding thus losses caused by flow resistances, for example. The operating efficiency of the vacuum means is also otherwise better than is known in the art and the vacuum level can be adjusted if required. The vacuum means can also be used as part of the frame construction, which further simplifies the construction of the vacuum belt conveyor. At the same time, projecting parts are avoided, which would collect loose material on top.

The invention is described below in detail by making reference to the enclosed drawings illustrating some of the embodiments of the invention.

DESCRIPTION OF THE PREFERRED EMBODIMENTS

Figure 1:
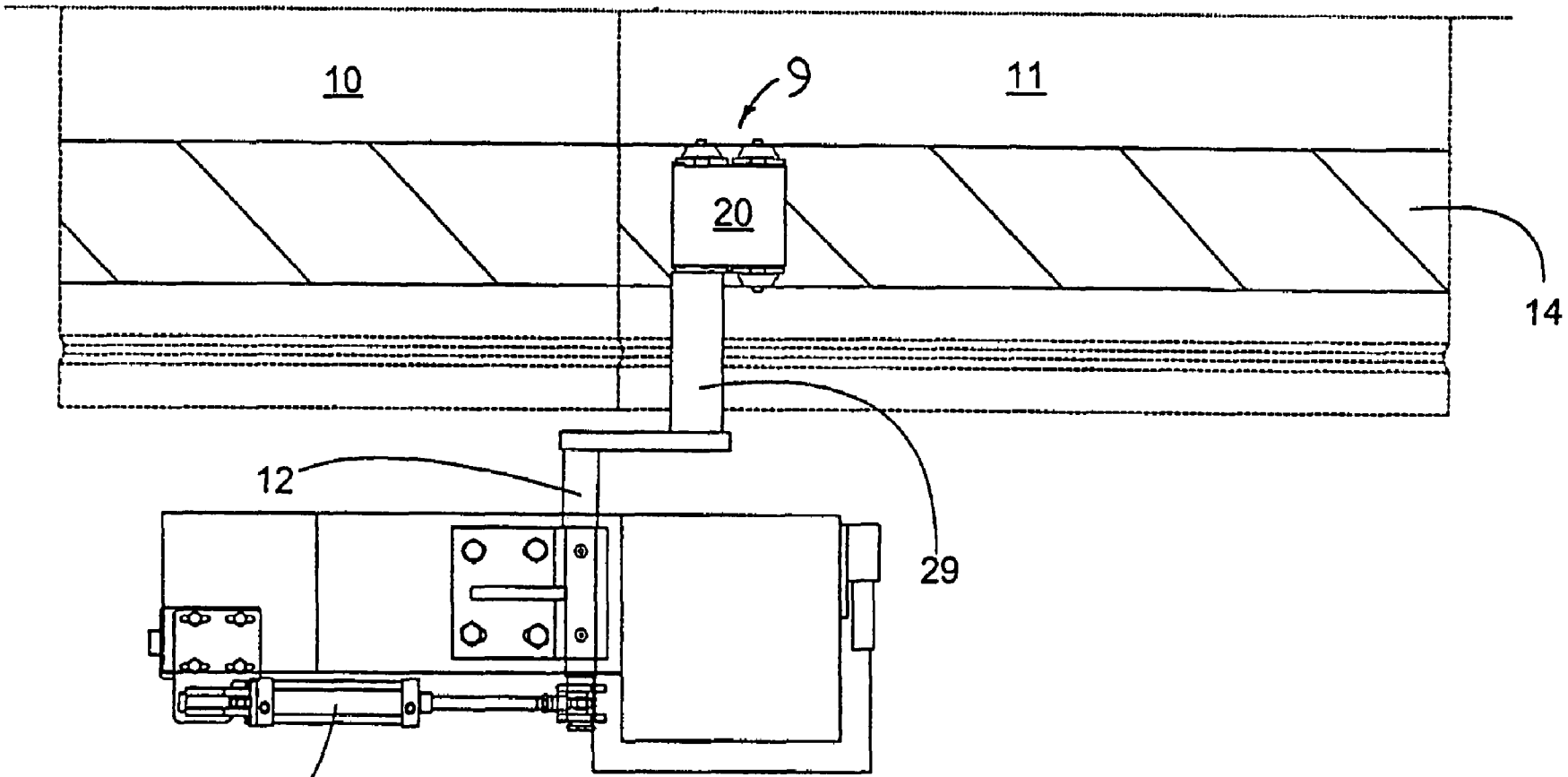
FIG. 1 is a top view of a vacuum belt conveyor according to the invention in the operating position.

A vacuum belt conveyor 9 according to the invention is used particularly for transferring and guiding a web threading tail in paper and board machines and other similar web manufacturing machines. The vacuum belt conveyor 9 is later referred to simply as a conveyor. FIG. 1 shows a conveyor 9 according to the invention in the operating position. Here the conveyor 9 is set in the dryer section of a paper machine in connection with dryers 10 and 11. For example the dryer section can comprise 20 to 30 conveyors, which can be turned to the rest position during the normal operation of the dryer section. For this, the conveyor 9 is turnably supported to the dryer section construction by means of an articulated arm 12 having a section 29.

In the conveyor 9 illustrated in FIG. 1, the articulated arm 12 is mounted with bearings at one point to the dryer section construction. Likewise, the conveyor 9 is fastened to one branch of the articulated arm 12 and the actuator 13 to the other branch. Here the actuator 13 is a pneumatic cylinder, which is also fastened to the dryer section construction. With suitable dimensioning, the conveyor 9 can be moved in a simple manner to a sufficient distance from the dryer and the web. In addition, the conveyor 9 is easy and fast to turn from the rest position to the operating position and back. In FIG. 1 the articulated arm 12 is mounted with bearings along a machine directional line. In this case the conveyor 9 can be turned away from the vicinity of the machine components. Another method used is to mount the articulated arm with bearings along a machine directional line (not shown). In this case the actuator 13 can be used to turn the conveyor 9 completely away from between the dryers 10 and 11, whereat damaging and soiling of the conveyor 9 is unlikely. Likewise, servicing the conveyor 9 is possible even with the dryer section in normal operation. By arranging suitable adjustment allowances in the articulated arm and its supporting, a single type of conveyor can be adapted even in many different positions. Besides the dryer section, the conveyor 9 according to the invention can as well be used in other locations in the web manufacturing machine, such as in the press section or the finishing section. The web threading tail 14 is shown in FIGS. 1 and 2.

Figure 2:
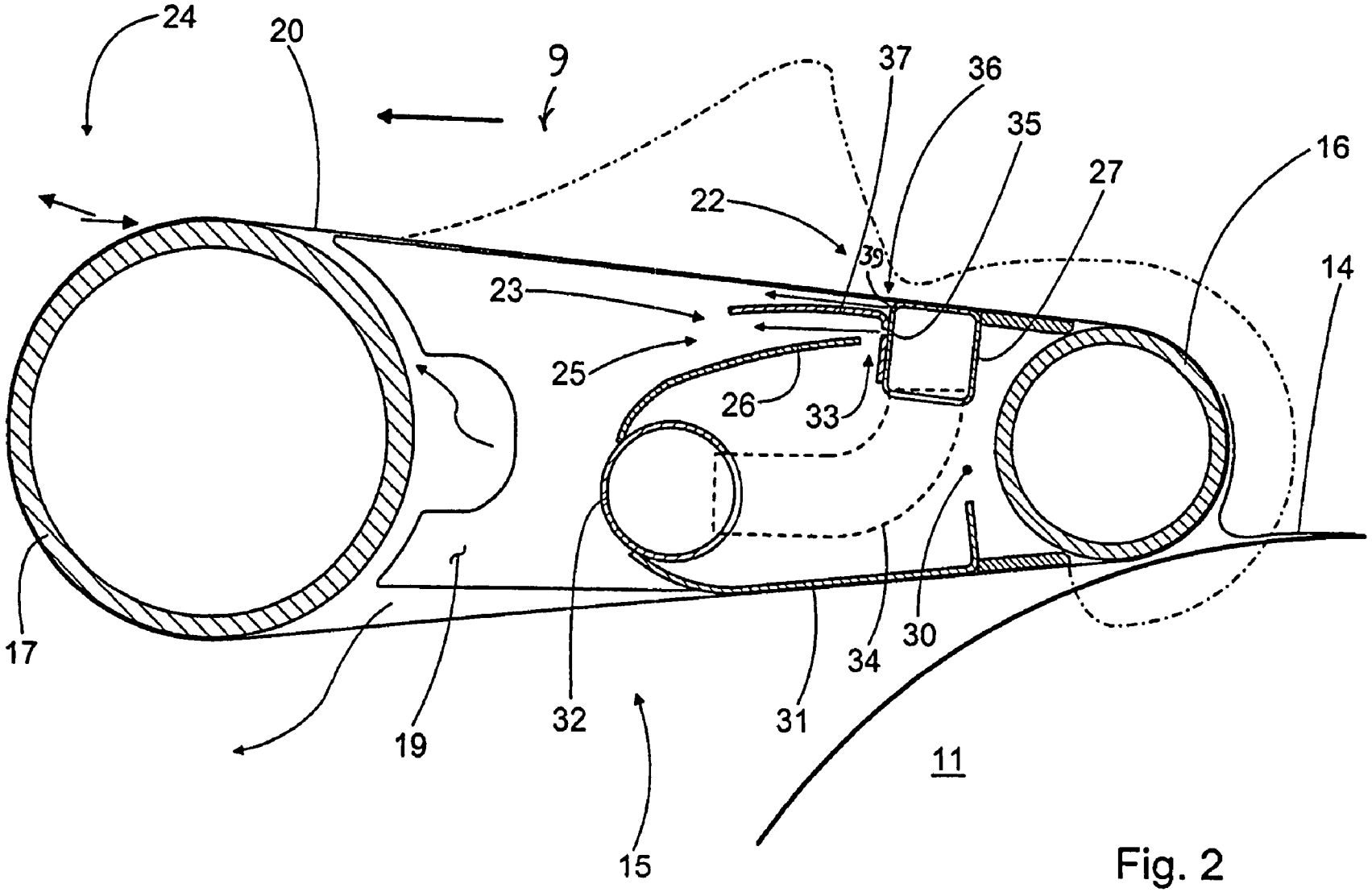
FIG. 2 is a cross-sectional view of the device of FIG. 3, taken along section line A-A.
Figure 3:
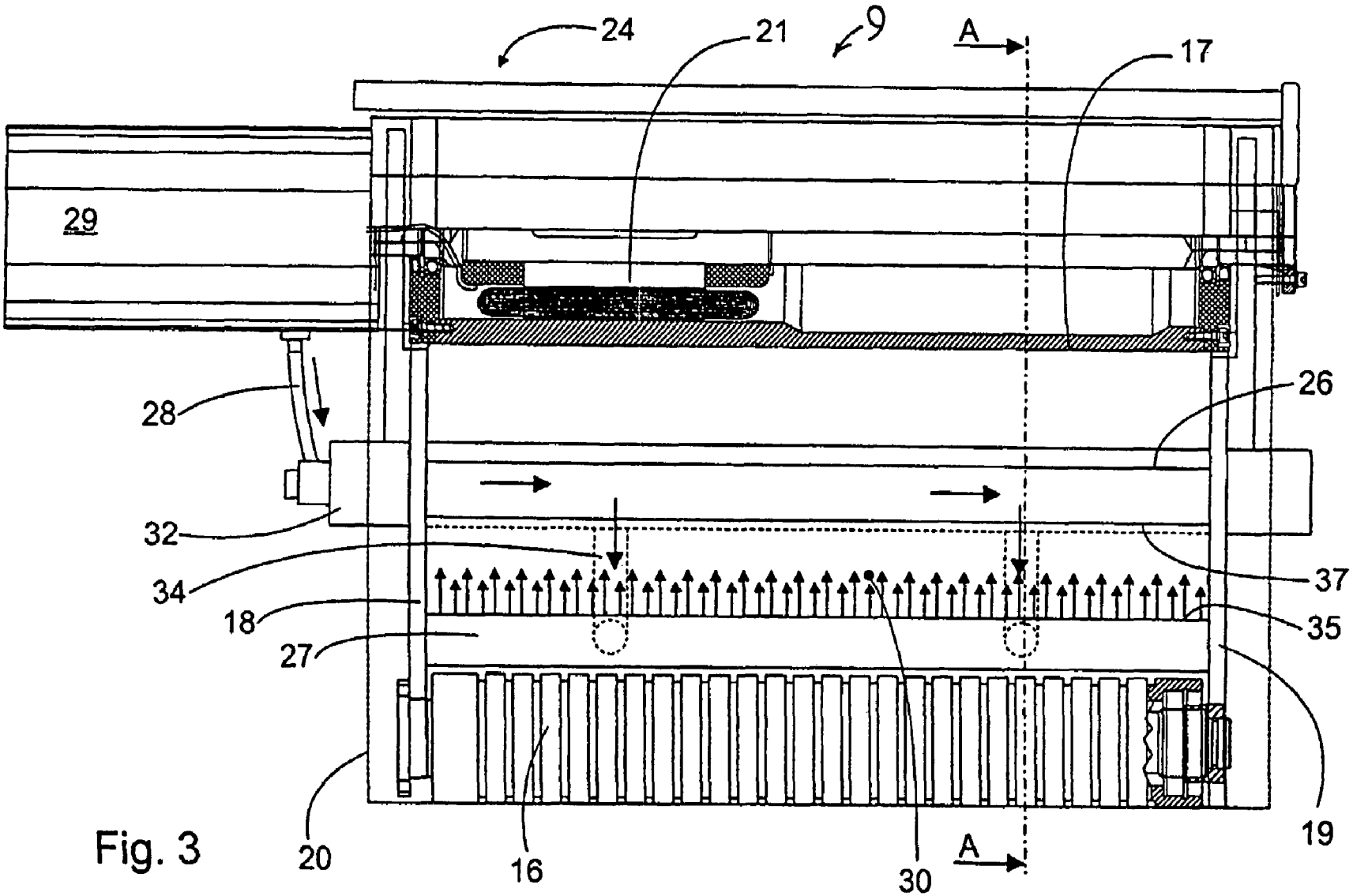
FIG. 3 is a partially sectional view of a vacuum belt conveyor according to the invention seen from above.

As shown in FIGS. 2 and 3, the conveyor 9 comprises a frame construction 15 and at least two pulleys therein, hereinafter referred to as rolls 16 and 17. The frame construction is composed of side plates 18 and 19, which are supported to each other with suitable cross-directional constructions. The conveyor 9 additionally comprises a belt loop 20, which is arranged around the rolls 16 and 17. In practice, the belt loop 20 is usually an air permeable fabric. In addition, the belt loop 20 is arranged to rotate in the travel direction of the web threading tail 14 supported by the rolls 16 and 17. In the embodiment set forth, the drive motor 21 is inside the larger roll 17.

The conveyor 9 also comprises a first vacuum means 22 for creating a vacuum effect in the part of the belt loop 20 that transports the web threading tail 14. Further, the conveyor 9 comprises second vacuum means 23 for creating a vacuum effect in connection with the first roll 16 of the two rolls. Consequently, the web threading tail 14 can be detached from the dryer 11 surface as shown in FIG. 2 and at the same time transferred further transported by the belt loop 20. The belt loop 20 is loose from the dryer 11 surface and the web threading tail 14 is detached by the mere vacuum effect. In FIG. 2 the intensity of vacuum is shown in principle with a dot-and-dash line. Over a great part of the circumference of the first roll 16 the vacuum is uniform. Before the first vacuum means 22 the vacuum reduces slightly, but increases rapidly to its maximum value. After this the vacuum decreases gradually. Near the second roll, it is possible to have even overpressure such that the web threading tail detaches easily from the belt loop.

The detachment of the web threading tail can be ensured with air doctors 24, which are arranged in connection with the second roll 17, as shown in FIG. 3. FIG. 2 shows only the blowing directions of these air doctors 24. The first blow is used to detach the web threading tail from the belt loop surface and the second blow is used to guide it forward.

According to the invention, the second vacuum means 23 are arranged in the frame construction 15. In this case the vacuum to be introduced to the first roll 16 is created inside the belt loop 20. This simplifies the conveyor construction and improves the operating efficiency of the vacuum means. In the embodiments set forth the second vacuum means 23 are composed of an air blowing apparatus 25. In practice, the air blowing apparatus 25 is composed of a functional blow plate 26 and an air distribution pipe 27 connected thereto. Thus the vacuum is generated near the application point and it is evenly distributed to the first roll 16. According to FIG. 3 the air distribution pipe 27 is connected to a compressed air connection 28 included in the conveyor 9. In practice the compressed air connection 28 is arranged within the pipe bracket 28 and so are the electric wires of the drive motor 21. The drive motor is also provided with a connection to the pipe bracket, which allows removing heated air from the drive motor. On the other hand, cooling air can be supplied to the drive motor through the pipe bracket.

The requirement for the operation of a conveyor as described above is a vacuum effect arranged in connection with the first roll. In the embodiment of FIG. 3, a grooved roll 16 is used. A perforated roll can also be used and the vacuum can be introduced from the roll end, for example. On the other hand, the vacuum can be taken from a vacuum chamber for either a grooved or a perforated roll depending on the application.

Preferably arranged inside the belt loop 20 there is a vacuum chamber 30, in which a vacuum is arranged using the second vacuum means 23 according to the invention. From the vacuum chamber 30 the vacuum extends to the belt loop via the roll grooves, which allows generating the force that is required for detaching the web threading tail. Here the vacuum chamber 30 is delimited by the air distribution pipe 27 and the blow plate 26 arranged in connection with it. Together with the blow plate 26, the air blow discharging from the air distribution pipe 27 creates a so-called coanda effect. In practice the air blow conveys surrounding air with it. The thus created air deficiency generates a vacuum that extends to the web threading tail through the belt loop. For example in the embodiment of FIG. 3 the belt loop 20 is 550 mm wide and the belt loop 20 is illustrated with a broken line.

In the embodiment of FIG. 2 the vacuum chamber 30 is also delimited by a bottom plate 31 and a separate supply pipe 32. Air discharging from the blow plate 26 is removed before the second roll 17 from the side of the conveyor 9 and partly through the belt loop 20. These solutions provide a particularly compact construction, which is additionally efficient and reliable. Generally thus arranged in connection with the first roll 16 there is a vacuum chamber 30, which is at least partly delimited by the second vacuum means 23. Aspiration caused by the coanda effect extends to the vacuum chamber through the gap or opening 33 between the air distribution pipe 27 and the blow plate 26. In principle the air distribution pipe 27 could be directly connected to the compressed air connection. However, for ensuring a uniform air flow, a cross-directional supply pipe 32 is used as well as compensating pipes 34 connected thereto, which end at the actual air distribution pipe 27. Thus, compressed air is uniformly distributed in the supply pipe and air distribution pipe over the entire width of the belt loop and is then discharged through the nozzle holes of the air distribution pipe creating the above mentioned coanda effect. Consequently, the vacuum in the vacuum chamber is as uniform as possible over the entire length of the roll.

In practice, the air distribution pipe 27 thus comprises nozzle holes 35 arranged at a distance from each other in the cross direction of the frame construction for providing air blowing. The size and relative positioning of the nozzle holes can be used to influence the intensity of the vacuum created. On the other hand, the vacuum effect can also be adjusted by changing the air volume used and its overpressure. If required, the nozzle holes are composed of adjustable nozzles. In addition, the air blowing apparatus is oriented in the longitudinal direction of the belt loop. In other words, the air blows are in the longitudinal direction of the conveyor, thus avoiding disturbing side flows.

In the embodiment of FIG. 2 the first vacuum means 22 are composed of a second air blowing apparatus 36. That is, for creating a vacuum, a second blow plate 37 is used in connection with the part of the belt loop that transports the web threading tail. In this case the air blow between the second blow plate 37 and the belt loop 20 conveys air with it, which tends to become compensated through the belt loop 20. The air blow is discharged from the air distribution pipe 27 through nozzle holes 39. A further advantage is achieved by arranging so that the first and second air blowing apparatuses share the air distribution pipe 27 between them. In this case one compressed air supply provides two air blows and vacuum effects, which are separate from each other. The relative intensity of the air blows can be adapted by changing the nozzle holes 35, 39 and their number.

Figure 4:
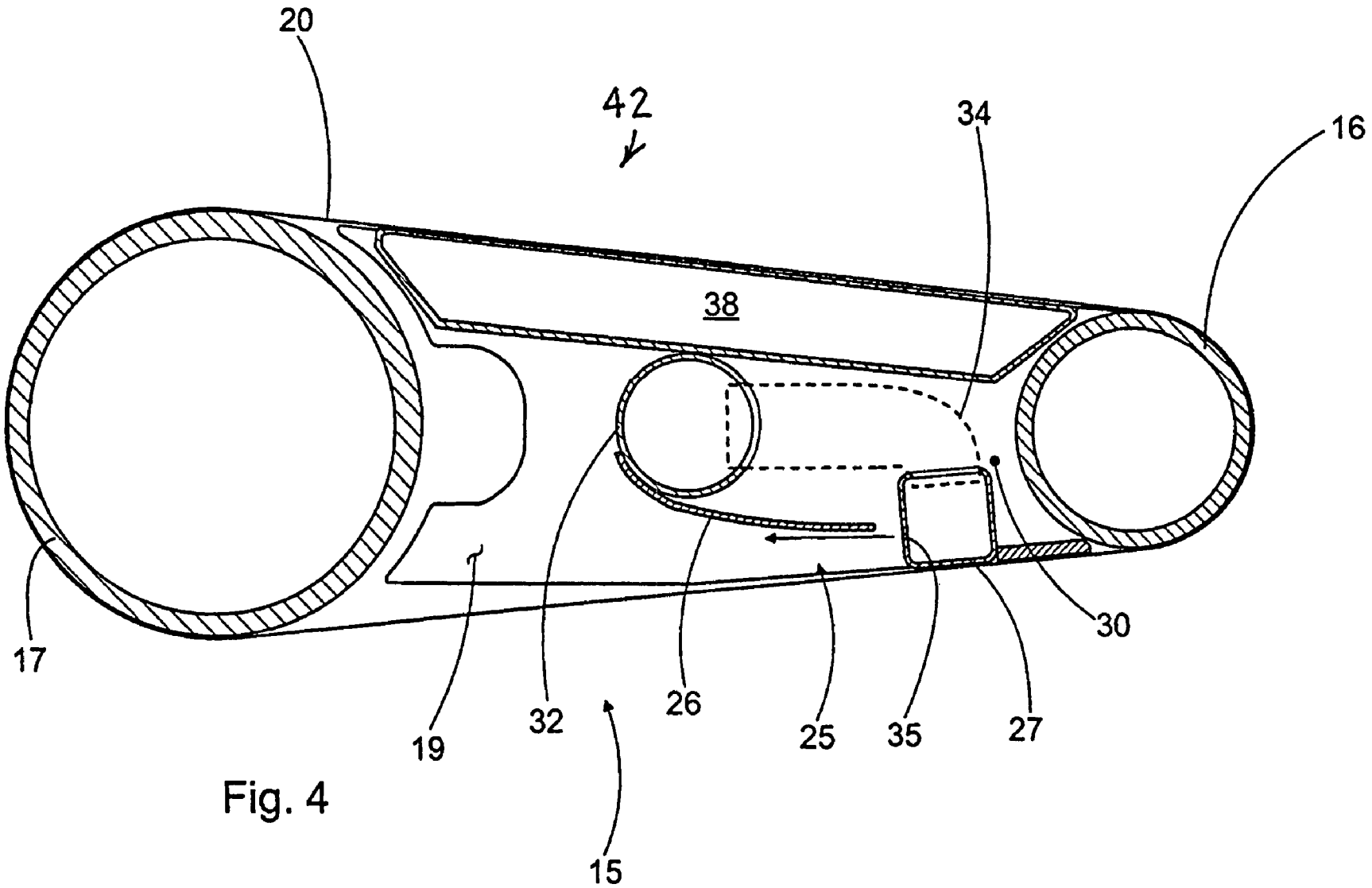
FIG. 4 is a side cross-sectional view of a second embodiment of the vacuum belt conveyor according to the invention.
Figure 5:
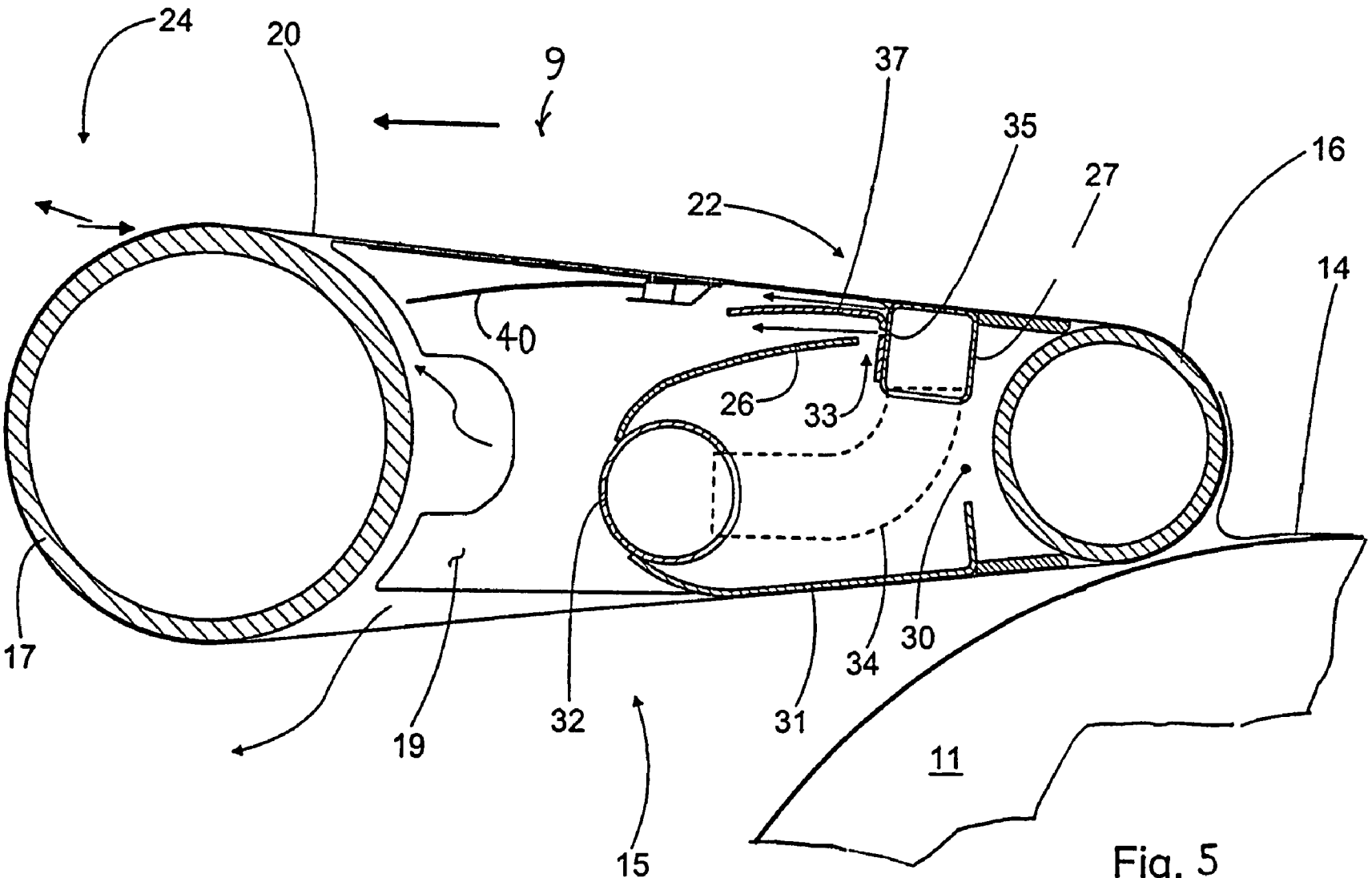
FIG. 5 is a schematic view of the apparatus of this invention having foil blades in addition to an air blowing apparatus.
Figure 6:
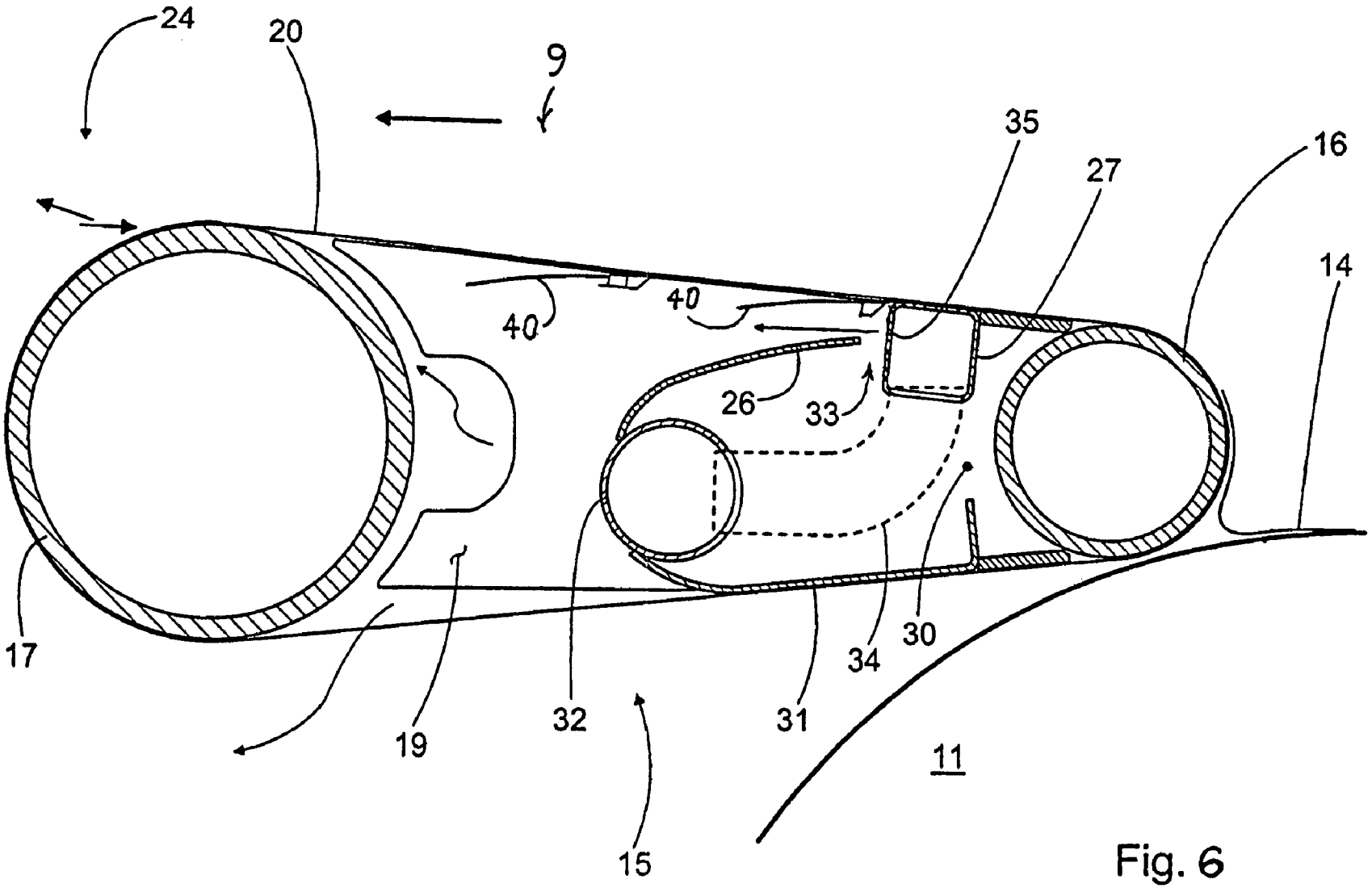
FIG. 6 is a schematic view of the apparatus of this invention having foil blades in place of one of the air blowing apparatuses of FIG. 2.

In the embodiments of FIGS. 2 and 4 the air distribution pipe 27 is arranged in contact with the belt loop 20. In this case a vacuum is created at the trailing edge of the air distribution pipe 27, which is then intensified with the above-mentioned second blow plate 37 and the air blow connected thereto. After the first roll it is also possible to adapt one or more foil blades 40, the tip of which contacts the inner surface of the belt loop (as shown in FIGS. 5 and 6). The foil blade 40 creates a vacuum without compressed air by means of the mere co-operation between the foil blade and the moving belt loop. Instead of (as in FIG. 6) or in addition to (as in FIG. 5) the blow plate, the first vacuum means can thus be composed of at least one foil blade or a combination of a foil blade and an air blowing apparatus.

In addition to the above, it is also possible to use one or more vacuum boxes 38, as in the conveyor 42, shown in FIG. 4, in which one continuous vacuum box 38 is arranged at the part of the belt loop 20 that transports the web threading tail 14. Suitable openings are provided on the top surface of the vacuum box for directing the vacuum effect to the web threading tail through the belt loop. When using a vacuum box the required vacuum is created elsewhere and introduced to the vacuum box. In FIG. 4, the second vacuum means 23 are arranged in the returning part of the belt loop and the vacuum box 38 partly delimits the vacuum box 30. Identical reference numbers are used for functionally similar parts.

A vacuum belt conveyor according to the invention is simpler than heretofore and thus more economical to manufacture. By combining constructions and functions it is possible to avoid for example piping, which brings further savings. Practical tests have additionally shown that the required vacuum is achieved with a compressed air amount of as much as 40 percent smaller than heretofore. In addition, the vacuum can be adjusted more easily and accurately than before.

We claim:

1. A vacuum belt conveyor for transferring a web threading tail in a web manufacturing machine; the vacuum belt conveyor comprising:

a frame construction;

at least two rolls comprising a first roll and a second roll mounted to the frame construction;

an air permeable belt loop arranged around the rolls;

a first means for providing a vacuum effect for a portion of the belt loop that transports the web threading tail; and a second means for providing a vacuum effect in connection with the first roll, wherein the second means is a structure arranged in the frame construction for creating a vacuum in a vacuum chamber adjacent to and in communication with the first roll to be introduced to the first roll inside the belt loop.

2. The vacuum belt conveyor of claim 1 wherein the second means comprises an air blowing apparatus.

3. The vacuum belt conveyor of claim 2 wherein the air blowing apparatus is comprised of a functional blow plate and an air distribution pipe connected thereto, which is connected to a compressed air connection included in the belt conveyor.

4. The vacuum belt conveyor of claim 2 wherein the air blowing apparatus is oriented in a cross machine direction belt loop.

5. The vacuum belt conveyor of claim 1 wherein the first means comprises a second air blowing apparatus, fitted with an air distribution pipe, which is common with the first air blowing apparatus.

6. The vacuum belt conveyor of claim 5, wherein the air distribution pipe is arranged in contact with the belt loop.

7. The vacuum belt conveyor of claim 3, wherein the air distribution pipe has portions defining nozzle holes spaced from each other in a cross machine direction for creating air blowing.

8. The vacuum belt conveyor of claim 1 wherein the first means comprises one or more vacuum boxes.

9. The vacuum belt conveyor of claim 1 wherein the first means comprises at least one foil blade or a combination of a foil blade and an air blowing apparatus.

10. A vacuum belt conveyor for transferring a web threading tail in a web manufacturing machine; the vacuum belt conveyor comprising:

a frame;

a first roll mounted to the frame;

a second roll mounted to the frame;

an air permeable belt loop mounted to travel in a first direction around the first roll and the second roll;

members connected to the frame which define a vacuum chamber adjacent to and in communication with the first roll, said members including a first blow plate, wherein a gap is defined between the air distribution pipe and the first blow plate, the gap communicating with the vacuum chamber;

an air distribution pipe connected to a source of compressed air;

a second blow plate extending adjacent the air distribution pipe and positioned between the first blow plate and the belt loop;

portions of the air distribution pipe which define a plurality of first nozzle holes through which blowing air is discharged across the gap and over the first blow plate, to thereby draw air from the vacuum chamber, for creating a vacuum to be introduced to the first roll inside the belt loop; and portions of the air distribution pipe which define a plurality of second nozzle holes through which blowing air is discharged over the second blow plate to thereby draw air through the belt loop.

11. The vacuum belt conveyor of claim 10 wherein the belt is driven in a machine direction, and wherein a cross machine direction is defined perpendicular to the machine direction, and wherein the air distribution pipe extends in the cross machine direction.

12. The vacuum belt conveyor of claim 11, wherein the air distribution pipe nozzle holes are spaced from each other in the cross machine direction.

13. The vacuum belt conveyor of claim 10, wherein the air distribution pipe is arranged in contact with the belt loop.

14. A vacuum belt conveyor for transferring a web threading tail in a web manufacturing machine; the vacuum belt conveyor comprising:

a frame;

a first roll mounted to the frame;

a second roll mounted to the frame;

an air permeable belt loop arranged around the first roll and the second roll;

members connected to the frame which define a vacuum chamber adjacent to and in communication with the first roll, said members including a first blow plate;

an air distribution pipe connected to a source of compressed air, wherein a gap is defined between the air distribution pipe and the first blow plate;

portions of the air distribution pipe which define a plurality of first nozzle holes through which blowing air is discharged across the gap and the first blow plate, to thereby draw air from the vacuum chamber, for creating a vacuum to be introduced to the first roll inside the belt loop; and a vacuum box disposed adjacent the belt loop as it extends from the first roll to the second roll, the vacuum box having portions defining a plurality of holes adjacent the belt loop and being connected to a source of vacuum.

15. A vacuum belt conveyor for transferring a web threading tail in a web manufacturing machine; the vacuum belt conveyor comprising:

a frame;

a first roll mounted to the frame, the first roll being a grooved roll or a perforated roll;

a second roll mounted to the frame;

an air permeable belt loop arranged to contain and move around the first roll and the second roll, the belt movement defining a machine direction, the belt loop engaging grooves or perforations of the first roll;

members connected to the frame which define a vacuum chamber adjacent to and in communication with the first roll, the vacuum chamber arranged to draw a vacuum on at least a portion of the belt loop which engages the grooves or perforations of said first roll, said members including a first blow plate;

an air distribution pipe mounted to the frame, and extending in a cross machine direction transverse to the machine direction, the air distribution pipe connected to a source of compressed air, wherein a gap is defined between the air distribution plate and the first blow plate;

portions of the air distribution pipe which define at least one first nozzle hole through which blowing air is discharged across the gap and over the first blow plate, the first blow plate and the at least one first nozzle hole arranged so as to draw air from the vacuum chamber, for creating a vacuum to draw the vacuum on at least the portion of the belt loop which engages the grooves or the perforations of said first roll;

a second blow plate extending adjacent the air distribution pipe and positioned between the first blow plate and the belt loop; and portions of the air distribution pipe which define at least one second nozzle hole through which blowing air is discharged over the second blow plate to thereby draw air through the belt loop.

16. The vacuum belt conveyor of claim 15, wherein the at least one first air nozzle hole comprises a plurality of holes spaced from one another in the cross machine direction.

17. The vacuum belt conveyor of claim 15, wherein the at least second air nozzle hole comprises a plurality of holes spaced from one another in the cross machine direction.

18. A vacuum belt conveyor for transferring a web threading tail in a web manufacturing machine; the vacuum belt conveyor comprising:

a frame;

a first roll mounted to the frame;

a second roll mounted to the frame;

an air permeable belt loop mounted to travel in a first direction around the first roll and the second roll;

members connected to the frame which define a vacuum chamber adjacent to and in communication with the first roll, said members including a first blow plate, wherein a gap is defined between the air distribution pipe and the first blow plate, the gap communicating with the vacuum chamber;

an air distribution pipe connected to a source of compressed air;

portions of the air distribution pipe which define a plurality of first nozzle holes through which blowing air is discharged across the gap and over the first blow plate, to thereby draw air from the vacuum chamber, for creating a vacuum to be introduced to the first roll inside the belt loop; and at least one foil blade positioned to cooperate with the traveling belt loop which creates a vacuum to draw air through said belt loop.

* * * * *